US007862675B1

(12) United States Patent
Gray et al.

(10) Patent No.: US 7,862,675 B1
(45) Date of Patent: Jan. 4, 2011

(54) SLIP METHOD FOR PRESTRESSING BEAMS WITH BONDED TENDONS

(75) Inventors: Howard M. Gray, Old Town, ME (US); Habib J. Dagher, Veazie, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 0 days.

(21) Appl. No.: 12/794,940

(22) Filed: Jun. 7, 2010

Related U.S. Application Data

(60) Provisional application No. 61/184,553, filed on Jun. 5, 2009.

(51) Int. Cl.
*E04C 3/12* (2006.01)

(52) U.S. Cl. ..... 156/160; 156/229; 52/223.9

(58) Field of Classification Search ..... None
See application file for complete search history.

(56) References Cited

U.S. PATENT DOCUMENTS 6,105,321 A * 8/2000 KarisAllen et al. ..... 52/223.8

OTHER PUBLICATIONS

Rodrigo Silva-Henriquez, Chapter 3, Prestressing System Development and Feasibility of the Prestressing Method, Research Report written for the Department of Civil and Environmental Engineering and the AEWC Advanced Structures and Composites Center, University of Maine.

Rodrigo Silva-Henriquez, Chapter 4, Feasibility Testing of Prestressing Slip Method, Research Report written for the Department of Civil and Environmental Engineering and the AEWC Advanced Structures and Composites Center, University of Maine.

Rodrigo Silva-Henriquez, H. Gray, H. J. Dagher, and W. G. Davids, paper entitled Strength Performance of Prestressed GFRP-Glulam Beams.

* cited by examiner

*Primary Examiner*—Sam C Yao
(74) *Attorney, Agent, or Firm*—MacMillan, Sobanski & Todd, LLC

(57) ABSTRACT

A method for manufacturing a reinforced beam having a bonded tensile reinforcement member includes assembling a tensile reinforcement member to a beam, wherein adhesive is disposed between the tensile reinforcement member and the beam. A load is applied to the tensile reinforcement member to define a pre-tensioned tensile reinforcement member. A force is applied to urge the beam and the pre-tensioned tensile reinforcement member together. The load is released on the pre-tensioned tensile reinforcement member prior to the adhesive becoming cured, allowing longitudinal ends of the tensile reinforcement member to slide relative to the beam at longitudinal ends of the beam, and thereby forming a reinforced beam having a bonded tensile reinforcement member.

20 Claims, 3 Drawing Sheets

SLIP METHOD FOR PRESTRESSING BEAMS WITH BONDED TENDONS

CROSS REFERENCE TO RELATED APPLICATIONS

This application claims the benefit of U.S. Provisional Application No. 61/184,553 filed Jun. 5, 2009.

Inventors: Howard M. Gray and Habib J. Dagher.

BACKGROUND

Various embodiments of a method for manufacturing reinforced beams are described herein. In particular, the embodiments described herein relate to an improved method for manufacturing pre-stressed reinforced beams having bonded tendons.

Conventional glued-laminated (glulam) beams often fail in bending-induced tension. To strengthen glulam beams and delay or prevent such bending-induced tension failure, attempts have been made to reinforce glulam beams with different types of tensile reinforcement, such as fiber reinforced polymer (FRP) or glass fiber reinforced polymer (GFRP) on the tension face of the beam. Such FRP reinforcement offers good corrosion resistance and has a high strength-to-weight ratio. Increases in bending capacity of 50 percent or more when compared to unreinforced glulam have been achieved with FRP tensile reinforcement. The use of FRP reinforcement permits the use of glulam beams made with low-grade laminations and/or a reduction in wood volume.

It is further known that the strength of a glulam beam may be further increased if the tensile reinforcement is pre-tensioned prior to being bonded to the glulam. The bonding of the tensile reinforcement to the glulam beam pre-stresses the reinforced beam. This pre-stressing results in significant initial compressive stresses in the bottom of the reinforced beam that counteract the tensile bending stresses caused by external loads. It has been observed that longitudinal cracks may form at the longitudinal ends of the reinforced beam. The cracks are the result of high stresses in the vertical direction. Horizontal stresses, or shear stresses, and the vertical stresses, are known to be higher at the longitudinal ends than at the center of the reinforced beam. The above notwithstanding, it would be advantageous to provide an improved method for manufacturing a reinforced beam.

SUMMARY

The present application describes various embodiments of a method for manufacturing a reinforced beam. One embodiment of the method for manufacturing a reinforced beam having a bonded tensile reinforcement member includes assembling a tensile reinforcement member to a beam, wherein adhesive is disposed between the tensile reinforcement member and the beam. A load is applied to the tensile reinforcement member to define a pre-tensioned tensile reinforcement member. A force is applied to urge the beam and the pre-tensioned tensile reinforcement member together. The load is released on the pre-tensioned tensile reinforcement member prior to the adhesive becoming cured, allowing longitudinal ends of the tensile reinforcement member to slide relative to the beam at longitudinal ends of the beam, and thereby forming a reinforced beam having a bonded tensile reinforcement member.

Another embodiment of the method for manufacturing a reinforced beam having a bonded tensile reinforcement member includes assembling a tensile reinforcement member to a beam, wherein adhesive is disposed between the tensile reinforcement member and the beam. A load is applied to the tensile reinforcement member to define a pre-tensioned tensile reinforcement member. A force is applied to urge a first surface of the pre-tensioned tensile reinforcement member and a surface of the beam together within a press. The press includes a first press member and a second press member. Either the first surface of the pre-tensioned tensile reinforcement member or a surface of the first press member are roughened. A second surface of the pre-tensioned tensile reinforcement member and a surface of the first press member engage one another. The load on the pre-tensioned tensile reinforcement member is released prior to the adhesive becoming cured, allowing longitudinal ends of the tensile reinforcement member to slide between the beam and the first press member at longitudinal ends of the beam, and thereby forming a reinforced beam having a bonded tensile reinforcement member.

An additional embodiment of the method for manufacturing a reinforced beam having a bonded tensile reinforcement member includes assembling a tensile reinforcement member to a beam, wherein adhesive is disposed between the tensile reinforcement member and the beam. A load is applied to the tensile reinforcement member to define a pre-tensioned tensile reinforcement member. A force is applied to urge a first surface of the pre-tensioned tensile reinforcement member and a surface of the beam together within a press. The press includes a first press member and a second press member. A friction member is mounted to the first press member. A second surface of the pre-tensioned tensile reinforcement member and a surface of the friction member engage one another. A sliding frictional engagement between the second surface of the pre-tensioned tensile reinforcement member and the surface of the friction member has a pre-determined coefficient of friction. The load on the pre-tensioned tensile reinforcement member is released prior to the adhesive becoming cured, allowing longitudinal ends of the tensile reinforcement member to slide between the beam and the friction member at longitudinal ends of the beam, and thereby forming a reinforced beam having a bonded tensile reinforcement member.

Other advantages of the method for manufacturing reinforced beams will become apparent to those skilled in the art from the following detailed description, when read in light of the accompanying drawings.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As used in the description of the invention and the appended claims, the word "tendon" is defined as any suitable tensile reinforcement member formed from any desired material, such as glass fiber reinforced polymer (GFRP). Such GFRP may include any desired glass fiber, such as E-glass. Alternatively, such a tendon may be formed from other fiber reinforced polymers (FRP), or material such as carbon reinforced polymers and aramid reinforced polymers.

As described in below, the tendon includes longitudinal ends. As used herein, the term phrase "longitudinal ends of the tendon" is defined as the portions of the pre-tensioned tendon near the longitudinal ends of the beam.

Figure 2:
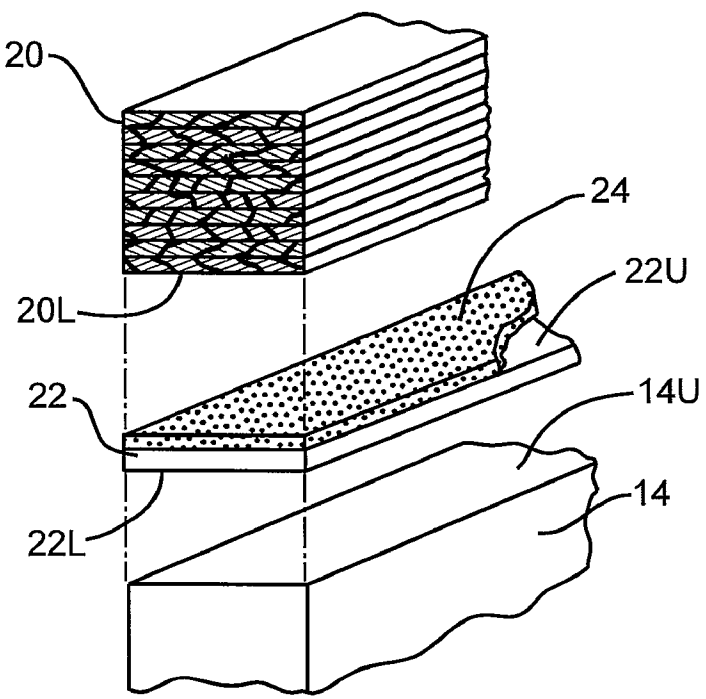
FIG. 2 is an exploded perspective view of a portion of the reinforced beam and the press illustrated in FIG. 1.
Figure 1:
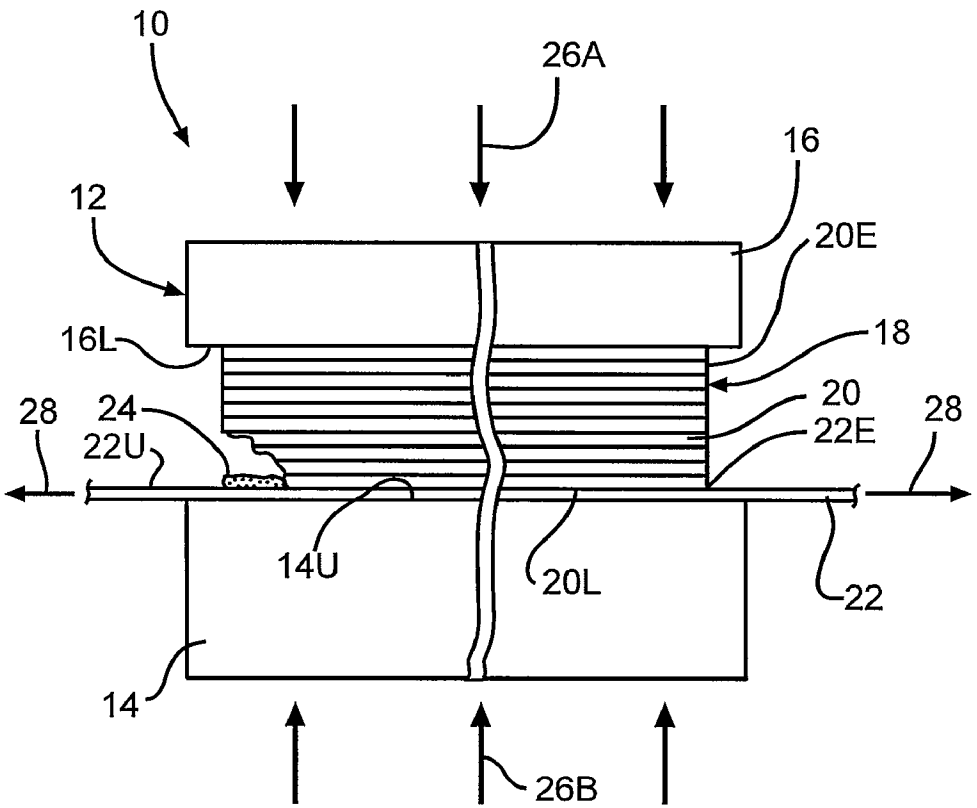
FIG. 1 is a schematic elevational view of a first embodiment of the method for manufacturing a reinforced beam according to the invention.

Referring now to FIGS. 1 and 2, a first embodiment of an apparatus for performing a first embodiment of the method for manufacturing a reinforced beam having a bonded tensile reinforcement member according to the invention is shown schematically at 10.

In the embodiment illustrated in FIG. 1, a press 12 includes a first press member 14 (lower member when viewing FIG. 1), and a second press member 16 (upper member when viewing FIG. 1). The first press member 14 has an engagement or upper surface 14U and the second press member 16 has an engagement or lower surface 16L. A reinforced beam 18 is shown being assembled in the press 12. The reinforced beam 18 includes a beam 20, a tensile reinforcement member or tendon 22, and a layer of adhesive 24 between a lower surface 20L of the beam 20 and a first or upper surface 22U of the tendon 22.

The tendon 22 includes longitudinal ends 22E and the beam 20 includes longitudinal ends 20E. As defined above, the longitudinal ends 22E of the tendon 22 are the portions of the pre-tensioned tendon 22 near the longitudinal ends 20E of the beam 20.

Figure 4:
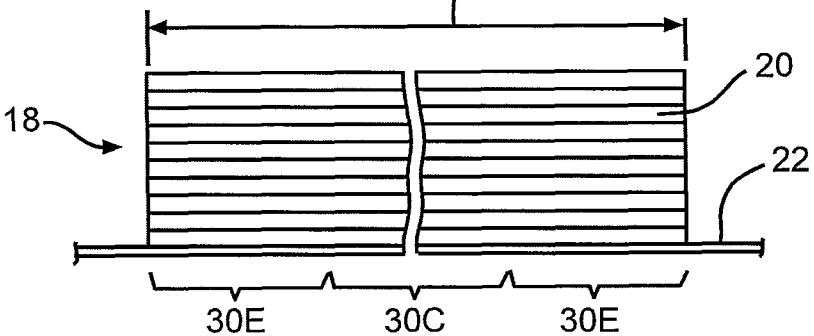
FIG. 4 is a schematic elevational view of the reinforced beam illustrated in FIG. 1.

As best shown in FIG. 4, the reinforced beam 18 may have any desired length L. For purposes of more clearly describing the advantages of the novel method described herein, the illustrated reinforced beam 18 includes a central zone 30C between opposing end zones 30E. Each end zone 30E may define any desired portion of the reinforced beam 18, such as a portion having a length within the range of from about ¼L to about ⅓L. The central zone 30C may also define any desired portion of the reinforced beam 18, such as a portion having a length within the range of from about ⅓L to about ½L. Alternatively, the end zone 30E may have a length less than ¼L or larger than ⅓L, and the central zone 30C may have a length less than ⅓L or larger than ½L.

In the illustrated embodiment, the beam 20 is a glued-laminated (glulam) beam; i.e., a structural timber product composed of several layers of dimension lumber glued together. Alternatively, the beam 20 may be any desired beam, such as a composite beam or a wood-plastic composite beam.

In the illustrated embodiment, the tensile reinforcement member or tendon 22 is a glass fiber reinforced polymer (GFRP).

In the illustrated embodiment, the adhesive 24 is phenol resorcinol formaldehyde adhesive (PRF). The PRF adhesive is prepared with resin and hardener, such as produced by Hexion Company of Springfield, Oreg. It will be understood that the type of adhesive chosen for the method will depend on the material composition of the beam 20 and the tendon 22.

The press 12 may be any desired press configured to provide a desired clamping force on the reinforced beam 18. As described below, in the embodiments described herein, the clamping force is a force within the range of from about 110 psi to about 165 psi. Because the clamping force 26A and/or 26B required will vary depending on the combination of the pre-tension load 28 applied to the tendon 22, the type of adhesive 24, and the coefficient of friction between the tendon 22 and a surface into which the tendon 22 is urged, such as the upper surface 14U of the first press member 14, other clamping forces 26A and/or 26B may be required. For example, a clamping force less than 110 psi or larger than 165 psi may be applied. Additionally, as described below, the clamping force may vary along the length of the beam 20.

In the illustrated embodiment, a first force, indicated by the arrows 26A, may be applied by the second press member 16 (downwardly when viewing FIG. 1). A second force, indicated by the arrows 26B, may be applied by the first press member 14 (upwardly when viewing FIG. 1). It will be understood that the clamping force may include one or both of the first and second forces 26A and 26B.

In operation, the method for manufacturing the reinforced beam 18 having a bonded tensile reinforcement member or tendon 22 includes assembling the tendon 22 to the beam 20. The adhesive 24 is disposed between the tendon 22 and the beam 20. In the illustrated embodiment, a layer of adhesive 24 is disposed between the lower surface 20L of the beam 20 and the upper surface 22U of the tendon 22. A desired pre-tension load, indicated by the arrows 28, may then be applied to the tendon 22 by any desired means, thereby defining a pre-tensioned tendon 22. In the illustrated embodiments and as described below, the pre-tension load 28 is a load within the range of from about 14 kilo pounds (kip) to about 22 kip. Alternatively, a pre-tension load 28 less than about 14 kip or larger than about 22 kip may be applied. It will be understood that the load may be applied to the tendon 22 prior to the tendon 22 and the beam 20 being assembled, or after the tendon 22 and the beam 20 have been assembled.

A force, indicated by the arrows 26A and 26B, may then be applied to either the beam 20, the tendon 22, or both to urge the beam 20 and the tendon 22 together. The force may be applied by any desired means. In the illustrated embodiment, the force is applied by the press 12. The illustrated press 12 may be any desired press configured to provide a desired clamping force 26A and/or 26B on the reinforced beam 18, such as a clamping force 26A and/or 26B within the range of from about 110 psi to about 165 psi. Alternatively, a clamping force 26A and/or 26B less than about 110 psi or larger than about 165 psi may be applied.

According to the first embodiment of the method 10 shown in FIG. 1, after assembly of the beam 20 and tendon 22 together, after the clamping force 26A and/or 26B is applied, and before the adhesive 24 becomes cured, the load 28 on the tendon 22 is released. Upon release of the load 28, longitudinal ends 22E of the tendon 22 may slip or slide relative to the beam 20 at longitudinal ends 20E of the beam 20 and within the end zones 30E.

Advantageously, the step of releasing the load on the tendon 22 reduces the load on the tendon 22 at the longitudinal ends 20E of the beam 20 relative to the load on the tendon 22 in the central zone 30C of the reinforced beam 18. In the illustrated embodiments, the step of releasing the load on the tendon 22 reduces the load on the tendon 22 at the longitudinal ends 20E of the beam 20 to about zero. In a specific embodiment of the method, the step of releasing the load on the tendon 22 reduces the load on the tendon 22 at the longitudinal ends 20E of the beam 20 to an amount less than about 0.5 kip.

A further advantage of the embodiments of the method for manufacturing a reinforced beam described herein is that the load on the tendon 22 at the longitudinal ends 20E of the beam 20 is reduced to about zero. The embodiments of the method for manufacturing a reinforced beam further allow for control of the distribution of the load on the tendon 22 along the length of the beam 20. The distribution of the load on the tendon 22 is directly related to the distance the tendon 22 may slide. The distance that the tendon 22 may slide within the end zones 30E will be greatest at the longitudinal ends 22E of the tendon 22. The distance that the tendon 22 may slide within the end zones 30E will vary depending on the length L of the beam 20, the adhesive 24, the clamping force 26A and/or 26B, the pre-tension load 28 applied to the tendon 22, the mechanical stiffness of the tendon, and the coefficient of friction between the tendon 22 and a surface into which the tendon 22 is urged, such as the upper surface 14U of the first press member 14. It will be understood that other characteristics and properties of the method of manufacturing a reinforced beam may also be considered when seeking to influence the distance that the tendon 22 may slide at the longitudinal ends 20E of the beam 20. In the illustrated embodiment, the tendon 22 may slide within the end zones 30E a distance within the range of from about 0.1 inches to about 0.3 inches. Alternatively, the tendon 22 may slide within the end zones 30E a distance less than about 0.1 inches or greater than about 0.3 inches.

Subsequent to the step of releasing the load on the pre-tensioned tendon 22, the novel method further includes continuing to apply or maintaining the force 26A and/or 26B applied to urge the beam 20 and the pre-tensioned tendon 22 together until the adhesive becomes cured. Until the adhesive is cured, the force 26A and/or 26B applied to urge the beam 20 and the pre-tensioned tendon 22 together is sufficient to maintain the load of the pre-tensioned tendon 22 within the central zone 30C of the reinforced beam 18. Advantageously, the load 28 on the pre-tensioned tendon 22 within the central zone 30C of the reinforced beam 18 is maintained while the load on the pre-tensioned tendon 22 at the longitudinal ends 20E of the beam 20 is reduced to about zero. In the illustrated embodiment, the load on the pre-tensioned tendon 22 within the end zones 30E gradually increases from about zero at the longitudinal ends 20E of the beam 20 to the central zone 30C, wherein the load 28 on the pre-tensioned tendon 22 remains substantially at its original pre-tensioned load 28. As used herein, the phrase "substantially at its pre-tensioned load" is defined as a load within the range of from about 90 percent to about 100 percent of the load initially applied to the tendon 22. Alternatively, the pre-tensioned load 38 may be less than about 90 percent of the load initially applied to the tendon 22.

By reducing the load on the pre-tensioned tendon 22 at the longitudinal ends 20E of the beam 20 to about zero, undesirable de-lamination or separation of the tendon 22 from the beam 20 due to peeling and shear stress developed at the longitudinal ends 20E of the beam 20 is substantially prevented.

Advantageous results may be achieved by manufacturing a reinforced beam 18 according to the novel method described herein; i.e., reducing the load on the pre-tensioned tendon 22 at the longitudinal ends 20E of the beam 20 to about zero. Such advantageous results may be achieved by selectively varying any or all of: the clamping force 26A and/or 26B, the pre-tension load applied to the tendon 22, and the coefficient of friction between the tendon 22 and the upper surface 14U of the first press member 14. It will be understood that other characteristics and properties of the method of manufacturing a reinforced beam may also be selectively varied to achieve the advantageous results described herein.

For example, the upper surface 14U may be roughened to increase the coefficient of friction between the tendon 22 and the upper surface 14U. The upper surface 14U may be roughened by any desired means, such as by grinding. The upper surface 14U may also be roughened by any other desired means, such as milling grooves.

Figure 3:
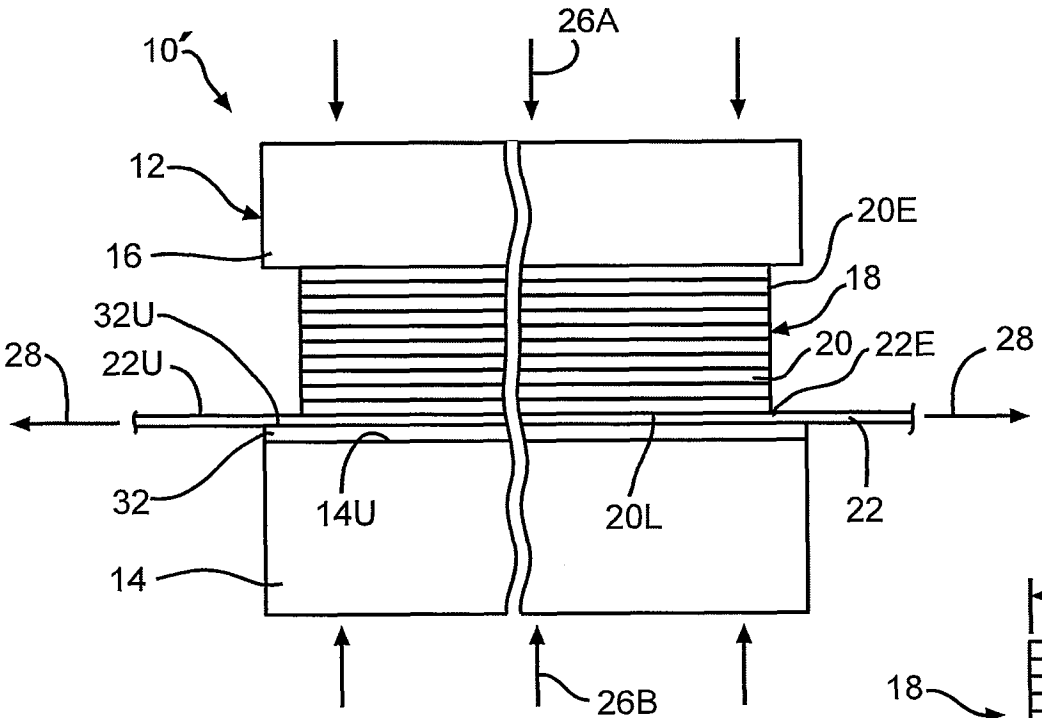
FIG. 3 is a schematic elevational view of an alternate embodiment of the method for manufacturing a reinforced beam illustrated in FIG. 1.

Referring now to FIG. 3, a second embodiment of an apparatus for performing a second embodiment of the method for manufacturing a reinforced beam 18 having a bonded tensile reinforcement member according to the invention is shown schematically at 10'. In the embodiment illustrated in FIG. 3, the press 12 includes the first press member 14 (lower member when viewing FIG. 3) and the second press member 16 (upper member when viewing FIG. 3). A friction member 32 includes an engagement or upper surface 32U and is mounted to the upper surface 14U of the first press member 14. The upper surface 32U may be roughened as described above.

Alternatively, the friction member 32 may be formed from, or coated with, one or more materials chosen to define a desired coefficient of friction between the tendon 22 and the upper surface 32U. The friction member 32 may also be formed from a combination of one or more materials and one or more coatings chosen to define the desired coefficient of friction between the tendon 22 and the upper surface 32U. Additionally, a combination of material and/or coatings may be used such that the material and/or coatings of the friction member 32 vary along the length of the beam 20. The second embodiment of the method 10' is otherwise identical to the first embodiment of the method 10 and will not be discussed in detail.

The upper surfaces 14U and 32U may be uniformly roughened along their entire lengths. Alternatively, the amount of roughness applied to the upper surfaces 14U and 32U may vary such that, for example, there is a higher coefficient of friction within the end zones 30E than in the central zone 30C.

Alternatively, a second or lower surface 22L of the tendon 22 may be modified to include a roughened surface. Such a roughened lower surface 22L may be created during formation of the tendon 22, or may be applied after the tendon 22 has been formed. It will be understood that either or both of the upper surface 14U and the lower surface 22L may be roughened. It will be further understood that either or both of the upper surface 32U and the lower surface 22L may be roughened.

In a third embodiment of the method of the invention, the clamping force 26A and/or 26B may be set to a pre-determined value selected to allow the longitudinal ends 22E of the tendon 22 to slide relative to the beam 20 within the end zones 30E, as described above. The desired result wherein the load on the pre-tensioned tendon 22 at the longitudinal ends 20E of the beam 20 is reduced to about zero is thus achieved. Alternatively, the clamping force 26A and/or 26B may be varied such that the clamping force 26A and/or 26B in the central zone 30C is greater than the clamping force 26A and/or 26B in the end zones 30E.

EXAMPLE

The present invention will be better understood by reference to the following example, which is offered by way of illustration not limitation.

As described above, the pre-tension load 28 applied to the tendon 22 is released while the adhesive is still wet. Upon release of the pre-tension load 28, frictional forces develop between the tendon 22 and the upper surface 14U of the first press member 14 within the end zones 30E, but not in the central zone 30C.

Figure 5:
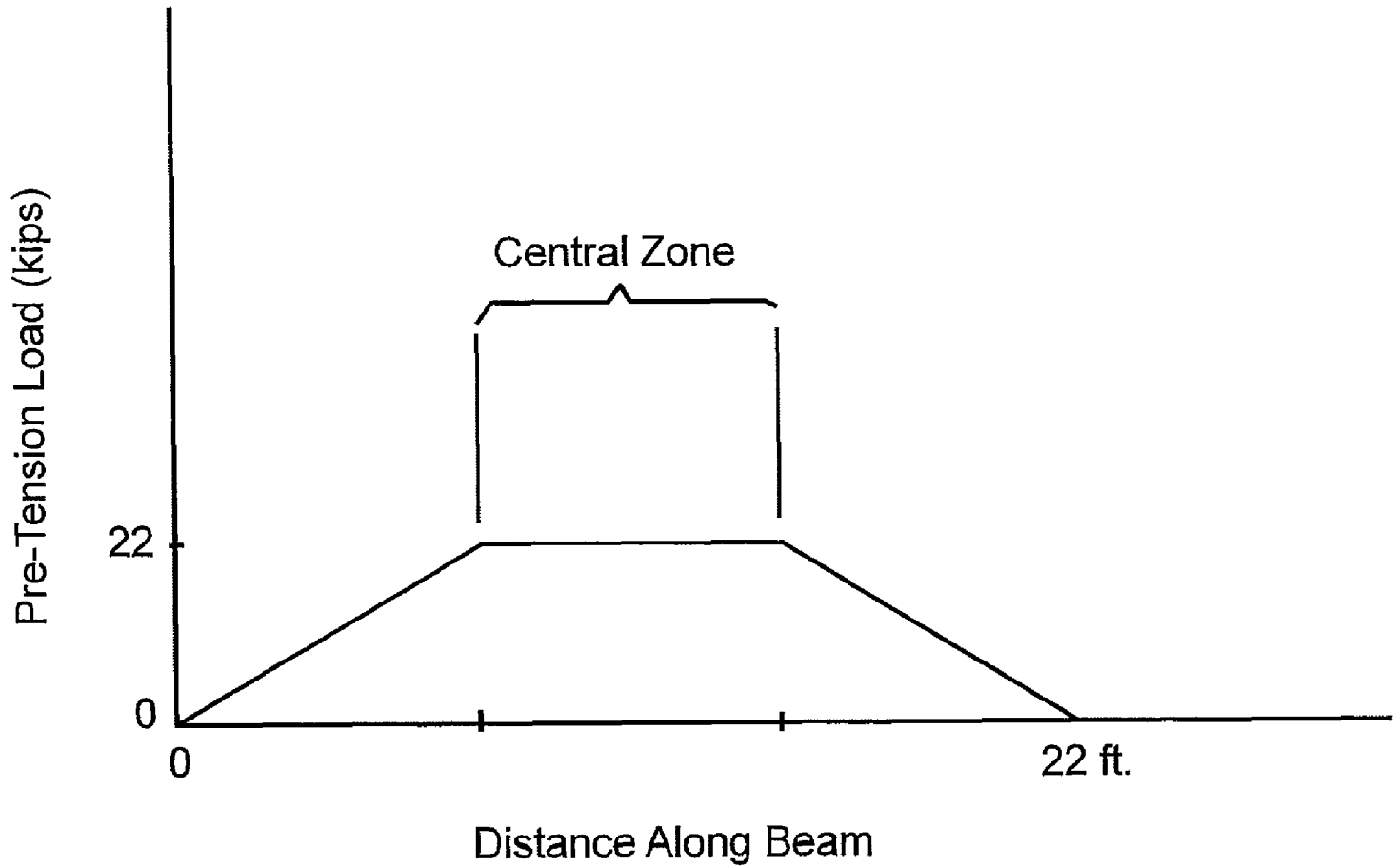
FIG. 5 is a graph of pre-tension load along the length of a reinforced beam manufactured according to the method illustrated in FIG. 1.

In one example of the method of the invention, a 4.47 in.×⅛ in. GFRP tendon 22 was assembled to a 5.125 in.×12 in.×22 ft. glulam beam 20. A 22 kip pre-tension load was applied to the tendon 22. A clamping force of 150 psi was applied. The surface 14U comprised roughened steel. After the pre-tension load 28 was released and the adhesive had cured, the pre-tension load on the tendon was measured. A graph of the pre-tension load along the length of the beam 20 has an approximately trapezoidal shape, as shown in FIG. 5. As shown in FIG. 5, the load on the pre-tensioned tendon 22 within the end zones 30E gradually increases from about zero at the longitudinal ends 20E of the beam 20 to substantially the original pre-tensioned load 28 at the central zone 30C.

The principle and mode of operation of the method for manufacturing a reinforced beam having a bonded tensile reinforcement member have been described in its preferred embodiment. However, it should be noted that the method for manufacturing a reinforced beam described herein may be practiced otherwise than as specifically illustrated and described without departing from its scope.

What is claimed is:

1. A method for manufacturing a reinforced beam having a bonded tensile reinforcement member, the method comprising:

assembling a tensile reinforcement member to a beam, wherein adhesive is disposed between the tensile reinforcement member and the beam;

applying a load to the tensile reinforcement member to define a pre-tensioned tensile reinforcement member;

applying a force to urge the beam and the pre-tensioned tensile reinforcement member together; and releasing the load on the pre-tensioned tensile reinforcement member prior to the adhesive becoming cured, thereby allowing longitudinal ends of the tensile reinforcement member to slide relative to the beam at longitudinal ends of the beam, thereby forming a reinforced beam having a bonded tensile reinforcement member.

2. The method according to claim 1, wherein the step of applying a load to the tensile reinforcement member occurs one of before and after the step of assembling a tensile reinforcement member to a beam.

3. The method according to claim 1, wherein the load applied to the tensile reinforcement member is within the range of from about 14 kip to about 22 kip.

4. The method according to claim 1, wherein the tensile reinforcement member is formed from glass fiber reinforced polymer.

5. The method according to claim 1, wherein the beam is a glue-laminated beam.

6. The method according to claim 1, wherein the step of applying a force to the at least one of the beam and the tensile reinforcement member includes applying a clamping force within the range of from about 110 psi to about 165 psi.

7. The method according to claim 1, wherein the step of releasing the load on the tensile reinforcement member reduces the load on the tensile reinforcement member at the longitudinal ends of the beam relative to the load on the tensile reinforcement member at a central zone of the reinforced beam.

8. The method according to claim 1, wherein the step of releasing the load on the tensile reinforcement member reduces the load on the tensile reinforcement member at the longitudinal ends of the beam to about zero.

9. The method according to claim 1, wherein subsequent to the step of releasing the load on the pre-tensioned tensile reinforcement member the method further includes retaining the force applied to urge the beam and the tensile reinforcement member together until the adhesive becomes cured, wherein the force applied to urge the beam and the tensile reinforcement member together is sufficient to maintain the load of the pre-tensioned tensile reinforcement member at a central zone of the reinforced beam.

10. The method according to claim 9, wherein the step of releasing the load on the pre-tensioned tensile reinforcement member reduces the load on the tensile reinforcement member at the longitudinal ends of the beam to about zero.

11. A method for manufacturing a reinforced beam having a bonded tensile reinforcement member, the method comprising:

assembling a tensile reinforcement member to a beam, wherein adhesive is disposed between the tensile reinforcement member and the beam;

applying a load to the tensile reinforcement member to define a pre-tensioned tensile reinforcement member;

applying a force to urge a first surface of the pre-tensioned tensile reinforcement member and a surface of the beam together within a press, wherein the press includes a first press member and a second press member, wherein one of the first surface of the pre-tensioned tensile reinforcement member and a surface of the first press member is roughened, and wherein a second surface of the pre-tensioned tensile reinforcement member and a surface of the first press member engage one another; and releasing the load on the pre-tensioned tensile reinforcement member prior to the adhesive becoming cured, thereby allowing longitudinal ends of the tensile reinforcement member to slide between the beam and the first press member at longitudinal ends of the beam, thereby forming a reinforced beam having a bonded tensile reinforcement member.

12. The method according to claim 11, wherein the step of applying a load to the tensile reinforcement member occurs one of before and after the step of assembling a tensile reinforcement member to a beam.

13. The method according to claim 11, wherein the load applied to the tensile reinforcement member is within the range of from about 14 kip to about 22 kip.

14. The method according to claim 11, wherein the tensile reinforcement member is formed from glass fiber reinforced polymer.

15. The method according to claim 11, wherein the beam is a glue-laminated beam.

16. The method according to claim 11, wherein the step of applying a force includes applying a clamping force within the range of from about 110 psi to about 165 psi.

17. The method according to claim 11, wherein the step of releasing the load on the tensile reinforcement member reduces the load on the tensile reinforcement member at the longitudinal ends of the beam relative to the load on the tensile reinforcement member at a central zone of the reinforced beam.

18. The method according to claim 11, wherein the step of releasing the load on the tensile reinforcement member reduces the load on the tensile reinforcement members at the longitudinal ends of the beam to about zero, wherein subsequent to the step of releasing the load on the pre-tensioned tensile reinforcement member the method further includes retaining the force applied to urge a first surface of the pre-tensioned tensile reinforcement member and a surface of the beam together until the adhesive becomes cured, and wherein the force applied to urge the beam and the tensile reinforcement member together is sufficient to maintain the load of the pre-tensioned tensile reinforcement member at a central zone of the reinforced beam.

19. A method for manufacturing a reinforced beam having a bonded tensile reinforcement member, the method comprising:

assembling a tensile reinforcement member to a beam, wherein adhesive is disposed between the tensile reinforcement member and the beam;

applying a load to the tensile reinforcement member to define a pre-tensioned tensile reinforcement member;

applying a force to urge a first surface of the pre-tensioned tensile reinforcement member and a surface of the beam together within a press, wherein the press includes a first press member and a second press member, wherein a friction member is mounted to the first press member, wherein a second surface of the pre-tensioned tensile reinforcement member and a surface of the friction member engage one another, and wherein a sliding frictional engagement between the second surface of the pre-tensioned tensile reinforcement member and the surface of the friction member has a pre-determined coefficient of friction;

releasing the load on the pre-tensioned tensile reinforcement member prior to the adhesive becoming cured, thereby allowing longitudinal ends of the tensile reinforcement member to slide between the beam and the friction member at longitudinal ends of the beam, thereby forming a reinforced beam having a bonded tensile reinforcement member.

20. The method according to claim 19, wherein the step of applying a load to the tensile reinforcement member occurs one of before and after the step of assembling a tensile reinforcement member to a beam.

* * * * *